US007258294B1

(12) United States Patent
Ralicki

(10) Patent No.: US 7,258,294 B1
(45) Date of Patent: Aug. 21, 2007

(54) COMPACTING APPARATUS

(76) Inventor: Daniel J. Ralicki, 16424 83rd St., Royalton, Morrison, MN (US) 56373

( * ) Notice: Subject to any disclaimer, the term of this patent is extended or adjusted under 35 U.S.C. 154(b) by 0 days.

(21) Appl. No.: 11/386,246

(22) Filed: Mar. 21, 2006

Related U.S. Application Data

(62) Division of application No. 11/026,703, filed on Dec. 30, 2004, now Pat. No. 7,028,610.

(51) Int. Cl.
*B02C 13/20* (2006.01)
*B02C 23/02* (2006.01)

(52) U.S. Cl. ..... 241/260.1; 241/247

(58) Field of Classification Search ..... 241/36, 241/260.1, 247, 248
See application file for complete search history.

(56) References Cited

U.S. PATENT DOCUMENTS 1,478,395 A * 12/1923 Pierce ..... 406/56
4,040,571 A * 8/1977 Lindeborg ..... 241/30
4,560,110 A * 12/1985 Burda ..... 241/36
4,632,317 A * 12/1986 Wexell et al. ..... 241/30
5,356,054 A * 10/1994 Loppoli et al. ..... 222/610
5,775,605 A * 7/1998 Tsai ..... 241/36
6,000,649 A * 12/1999 Loppoli ..... 241/260.1
6,267,497 B1 * 7/2001 Rhee ..... 366/186
7,028,610 B1 * 4/2006 Ralicki ..... 100/37

* cited by examiner

*Primary Examiner*—Faye Francis
(74) *Attorney, Agent, or Firm*—Albert W. Watkins

(57) ABSTRACT

A machining waste metal recycling machine has an in-feed hopper. The hopper uses paired augers to move the waste metal through the hopper to a cutting and transporting auger. The hopper augers are powered independently from each other, and may be individually reversed or reversed as a group to clear jams. In the event a jam is not cleared through one or more reversal cycles, the remaining augers may be operated to clear the hopper, thereby avoiding the need for manual unloading. Within the hopper are one or more shear bars that are provided to sever bunches or bundles of machining waste and thereby clear tangles which might otherwise jam the augers. The cutting and transporting augers ultimately feed a reciprocating compactor having a movable gate with one or more grooves for controlled drainage of machining oil and other liquid, as the machining waste metal is compressed into pellets.

9 Claims, 8 Drawing Sheets

COMPACTING APPARATUS

This application is a Div of Ser. No. 11/026,703 Dec. 30, 2004 U.S. Pat. No. 7,028,610.

BACKGROUND OF THE INVENTION

1. Field of the Invention

This invention pertains generally to presses, and more particularly to an apparatus which compacts various machining wastes into slugs through reciprocating motion, while providing drainage of machining oil and other liquid through or along a movable pressure surface. In a most preferred embodiment, novel hopper augers are powered independently from each other, and are cooperative with perpendicular shear bars which serve to sever bunches or bundles of machining waste.

2. Description of the Related Art

Modern man has distinguished himself from other creatures by an ability to make and use a very wide variety of tools and machines. Almost without regard to the type or ultimate purpose of a machine, one or more metals or alloys will be used in fabrication. These metals may in many cases form one or more parts of the machine, but may also or instead form one of the various tools that are used in the formation of one or more of the machine parts. As but one of a seemingly endless myriad of examples, even a device associated with modern technology, the computer, most frequently has a metal housing or box referred to as a case or enclosure surrounding the entire base or processor unit. The power supply found therein will also most frequently be enclosed in a metal box, and various bays and slots will most frequently be located upon various metal rails or housings inside the enclosure. A large number of metal fasteners, electrical connectors, and other metal or metal containing components will be found therein. Further, the various molded plastic components such as keyboard, mouse and monitor will likewise include various metal fasteners, sheets, and the like. Finally, the various molded plastic components are most frequently molded in metal molds and with metal tooling. While the example above pertains to computers specifically, and electrical devices more generally, a person will readily recognize that even components such as wood, which may be fabricated from non-metallic materials and without metal forms or molds, will be fabricated using metal components such as routers and shaping bits, saws, and the like. Consequently, even where the materials are primarily non-metallic, there is often a significant amount of metal used in the fabrication thereof.

Metals are materials of choice for a variety of reasons. One of these is the ability to be machined, while retaining structural integrity. As but one example, metal may be drilled by metal or ceramic drill bits. The drill bits will typically cut into the metal at the leading edge of the bit, literally forming spirals of thin metal, resembling helically coiled springs. The application of machining oil greatly facilitates this very controlled removal of metal. A similar removal process occurs in the lathing of metals into various cylindrical shapes.

Other techniques exist for the shaping of metals. Metals may be punched, permitting small slugs or sections to be removed from a sheet or blank. Various saws, grinders and milling machines exist for cutting and shaping. The machines used to work the metal are more and more frequently numerically controlled, and so may be used to make repetitive or precisely programmed machining patterns. Molten casting may also be used, to shape the metal while liquid within a form, such as a sand mold. These castings may likewise have a small amount of waste, such as the neck portion where the metal passes into the body of the mold. Various other techniques too numerous to mention exist, which further expand the utility of metals.

Large, relatively pure ore reserves exist and continue to be discovered, which has helped to keep the cost of metals low, and the number of affordable applications high.

Consequently, metal wastes produced in most fabrication shops have not heretofore received much priority. In years gone by, these metal shavings were simply hauled away to land fills, junk yards, or, in a few more progressive or higher volume cases, to metal recyclers for handling with other metal scraps and wastes. However, the volume of scrap produced from machining operations is very high compared to the actual weight of metal contained therein. To be more specific, the metal spirals that represent an optimum drilling or lathing operation are almost entirely air, with but a small amount of very thin metal and some machining oil. The hauling of this high volume, low weight scrap to central recyclers is, quite simply, inefficient and costly.

Even where this material is attempted to be recycled, the ordinary recycling processes have not worked well. The most common metal recycling processes melt and reform stock from collected waste. Unfortunately, the thin metal spirals tends to have very large surface area which is typically readily oxidized. This thin metal will often burn, instead of melting, and so will produce ash and soot instead of the desired liquid metal. Further, the machining oil produces large quantities of undesirable soot. Between the high transport costs and poor recycling yields, the practice has more frequently been landfill disposal or the like. Unfortunately, the high quantity of oil in the metal has been recognized to be a hazardous waste, subject to regulation by various environmental regulatory agencies. As a result, most metal fabrication operations have now come under some type of governmental regulation regarding suitable handling and disposal of these high-oil wastes. What has been much needed then is an apparatus and method suitable for improving the handling of these wastes produced within a metal working or fabrication shop. One particularly promising approach is the production of pellets, or slugs, of metal from the wastes. The pressing of the high-volume, low-density spirals into high-density, low-volume slugs decreases shipping volume and increases shipping and handling efficiency, helps to remove machining oil which may then be re-used instead of wasted, and vastly improves the melt efficiency and reduces the amount of undesirable ash, slag and soot produced during recycling.

Compactor apparatus are known which are used to reduce bulk scrap material to a compact form. In particular, compactors are used to reduce scrap material in the form of metal shavings, chips and the like that are entrained with cutting fluids, such as oil and coolant, to compact the bulk material into more recyclable pellets that take the form of a "hockey puck", while extracting the fluid for reuse. Such an apparatus for compacting metal shavings is shown and described for exemplary purposes in U.S. Pat. Nos. 5,391,069 and 5,542,348 by Bendzick, the teachings of each incorporated herein by reference. In these patents, machining shavings are auger-fed into a shredder, then compacted to form pellets, and fluid is recovered therefrom. Drainage of fluid occurs via tolerances in the cylinder, gate, and compactor walls. A discharge gate is provided at the exit of the cylinder. However, several deficiencies have been noted in the Bendzick approach. One limitation arises from the vertical orientation of pellet formation and discharge. When the shavings are compressed, fluid is released from around the pellet as the pellet is being formed. The fluid will be acted upon by the forces of gravity, as will the pellet during discharge. Consequently, it is rather difficult to effectively separate fluid from pellet, other than by the undesirable drying of pellets after compacting. However, and as noted by Bendzick, the formation of ordinary drainage channels, such as through a screen or the like, is very much complicated by the intense pressures used in the pressing of metal shavings and the like into pellets or slugs. In addition, during the machining of metals, the formation of very long spirals is commonplace. Unfortunately, these spirals may readily become intertwined with adjacent spirals when being moved about by the feed augers. In such instance, the auger will bind, and shut down the machine. In the prior art such as Bendzick, this has resulted in a need to completely empty the in-feed hopper, until the jam, which is usually at the bottom adjacent the auger, can be accessed and cleared. As may be apparent, such jam-clearing operations are very time consuming and dangerous, since these shavings are usually quite sharp and prone to springing about unexpectedly. As can be appreciated, where the hazards of operating the compacting machine exceed any expected return, the machine will be abandoned in favor of other techniques. Consequently, many shops have avoided implementing any compacting operations at all, owing to the lack of adequate reliability and efficiency of operation of these prior art machines.

Other technologies relating to various presses and augers are incorporated by reference herein for their teachings, including U.S. Pat. Nos. 1,247,078 by Carver; 4,303,412 by Baikoff; 4,947,743 by Brown et al; 5,182,988 by Styfhoorn; 1,481,806 by Montgomery; 2,892,397 by Finkelstein; 5,207,904 by Abel; 769,015 by Pierce; 906,321 by Sperry; 1,515,318 by Tennebaum et al; 975,844 by Egbert; 3,618,707 by Sluhan; 4,312,481 by Carey et al; 5,088,399 by Cacace et al; 5,147,554 by Heck; 5,167,839 by Widmer et al; 5,366,165 by Jackman; 5,722,604 by Dudley; and 6,406,635 by Smith et al. Nevertheless, these patents do not either singly or in combination teach a method or apparatus to overcome the aforementioned deficiencies in the Bendzick patents.

SUMMARY OF THE INVENTION

Exemplary embodiments of the present invention solve inadequacies of the prior art by providing a compactor apparatus of the type indicated above for compacting of scrap material entrained with fluid to form pellets or "pucks" of the scrap material and extract the fluid, for recycling of the pellet and reuse, recycling or otherwise separate handling of the fluid. In particular, the compactor compacts metal shavings entrained with cutting fluid as found in a machine shop. The shavings are compacted into pellets or "pucks" that can be sold to a recycler. The extracted fluid is reused in the various suitable machines found in the shop.

In the preferred embodiment, the compactor includes a supply hopper for collection of scrap material such as metal shavings entrained with cutting fluid. A bank of grinding augers forms the bottom of the supply hopper. This includes four parallel augers that operate in counter rotating pairs. Each auger is rotated by its own individual motor. The motor can be hydraulically, electrically, or otherwise powered. The augers grind up large pieces of the scrap material to a size suitable for compacting. A processor will preferably control the motors operating the individual augers. If an auger is jammed, causing it to stop, the processor will momentarily reverse direction of the motor to free the jammed material. The processor may optionally do this without affecting the rotation of the other augers. The jamming is detected by suitable means such as a force sensor, load sensing, or other suitable technique.

The grinding augers feed the material from the supply hopper to a manifold. A first horizontal conveying auger is located in the manifold. The horizontal conveying auger delivers ground up material entrained with fluid to a second conveying auger. The second conveying auger is inclined and carries the product upwardly to the top of a feed hopper.

The compactor apparatus includes a frame carrying a compactor cylinder assembly. The compactor cylinder assembly includes the feed hopper, a compactor piston and a cylinder. The compactor piston reciprocates back and forth in the cylinder. The cylinder has a top opening for introduction of scrap product. The piston fits in one end of the cylinder for reciprocal movement within it. The other end of the cylinder is closed by a moveable gate. The interior face of the gate has a pressure face with drain channels for draining of fluid extracted from waste product during the compacting process. The gate also has a discharge opening spaced from the pressure face for the discharge of the compacted pellet from the compactor cylinder assembly.

Scrap product enters the compactor cylinder from the feed hopper. The compactor piston is actuated to press the scrap product against the pressure face of the gate with a very large pressure thus forming a compact pellet in the shape of a cylinder or "hockey puck". As pressure is applied to the scrap material, it exudes fluids. The fluids are captured by drain channels that surround the pressure face of the gate. The drain channels direct the fluid away from the scrap material downwardly to a collection pan. The fluid can then be reused or recycled.

Following formation of the pellet, the piston backs away slightly. This permits movement of the gate so that the pressure face moves away from the cylinder end and the discharge opening moves into position with respect to the cylinder end. The piston is then advanced to a point where it pushes the pellet out of the cylinder through the discharge opening and to a collection bin located below.

In a first manifestation, the invention is a supply hopper suitable for supplying a compacting apparatus with metal scrap material entrained with fluid, and operative for receiving and supporting the metal scrap material therein. A plurality of augers are provided within the supply hopper that are operative to transport diverse sizes within the metal scrap material. At least one shear bar is cooperative with and extends substantially across the plurality of augers to shear oversized metal scrap material being transported. In a further optional manifestation, a means detects jams within individual ones of the plurality of augers. A means for selectively stopping and selectively reversing individual ones of the plurality of augers independently of other ones of the plurality of augers is responsive to the jam detecting means, whereby one or more individual augers will be reversed to clear a jam, and, if reversing fails to clear the jam, the remaining augers will continue to operate.

In a second manifestation, the invention is a compacting apparatus for compacting scrap material entrained with fluid to form pellets and extract fluid therefrom, for enabling more efficient and economical recycling of the metal and separate handling of machining fluid. A cylinder has an opening for introduction of scrap material, and a first end and a second end distal thereto. A compactor piston is adjacent to and closes the first end of the cylinder. A moveable gate having an aperture and a pressure face is moveable between a first position in which the pressure face selectively blocks passage of scrap material substantially from the second end of the cylinder and a second position in which the gate aperture is aligned with the second end to selectively permit passage of scrap material from the second end of the cylinder. The pressure face has at least one radial drain channel extending radially from the pressure face for draining fluid extracted from waste product during the compacting process. The aperture is spaced from and vertically above the pressure face, whereby extracted fluid is deterred from passing through the aperture by gravitational force.

In a third manifestation, the invention is a method for compacting scrap material entrained with fluid to form pellets and extracting the fluid therefrom, for recycling of pellets and separate handling of fluid. According to the method, scrap material is collected in a supply hopper. A plurality of augers are provided adjacent the bottom of the supply hopper. Individual ones of the plurality of augers are rotated independently from other ones. Clumps within the scrap material being carried forward by the augers are sheared against at least one, and preferably several shear bars cooperating with the plurality of augers. In a more specific manifestation of this method, a load on each of the individual ones of the plurality of augers is sensed to determine when an individual one of the plurality of augers is jammed. The rotating of jammed individual ones of the plurality of augers is controlled responsive to sensing the jam, to in one mode stop and in a second mode reverse a direction of rotation to free the jam. The load on the jammed individual one of the plurality of augers is detected subsequent to the controlling step to determine whether the jam still exists, and, if so, the other ones of the plurality of augers are continued to operate until the supply hopper is nearly or otherwise emptied, thereby greatly facilitating the clearing of the jam.

OBJECTS OF THE INVENTION

A first object of the invention is to provide a compactor suitable for forming solid slugs or pucks of metal, of high density and low volume, and with minimal or no entrained fluid. A second object of the invention is to reliably collect fluid exuded during the formation of the metal slug separately from the slug, thereby avoiding or minimizing the need for undesirable drying of pellets after compacting. Another object of the present invention is to provide a very reliable feed auger suited for properly feeding, and where appropriate, cutting long spirals and diverse materials. A further object of the invention is to controllably drive each auger separately, thereby facilitating reversal thereof. In the event of a bind, yet another object of the present invention is to enable the remaining augers to operate, to clear the hopper and provide access to the bound auger and avoid the need to manually empty the in-feed hopper.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
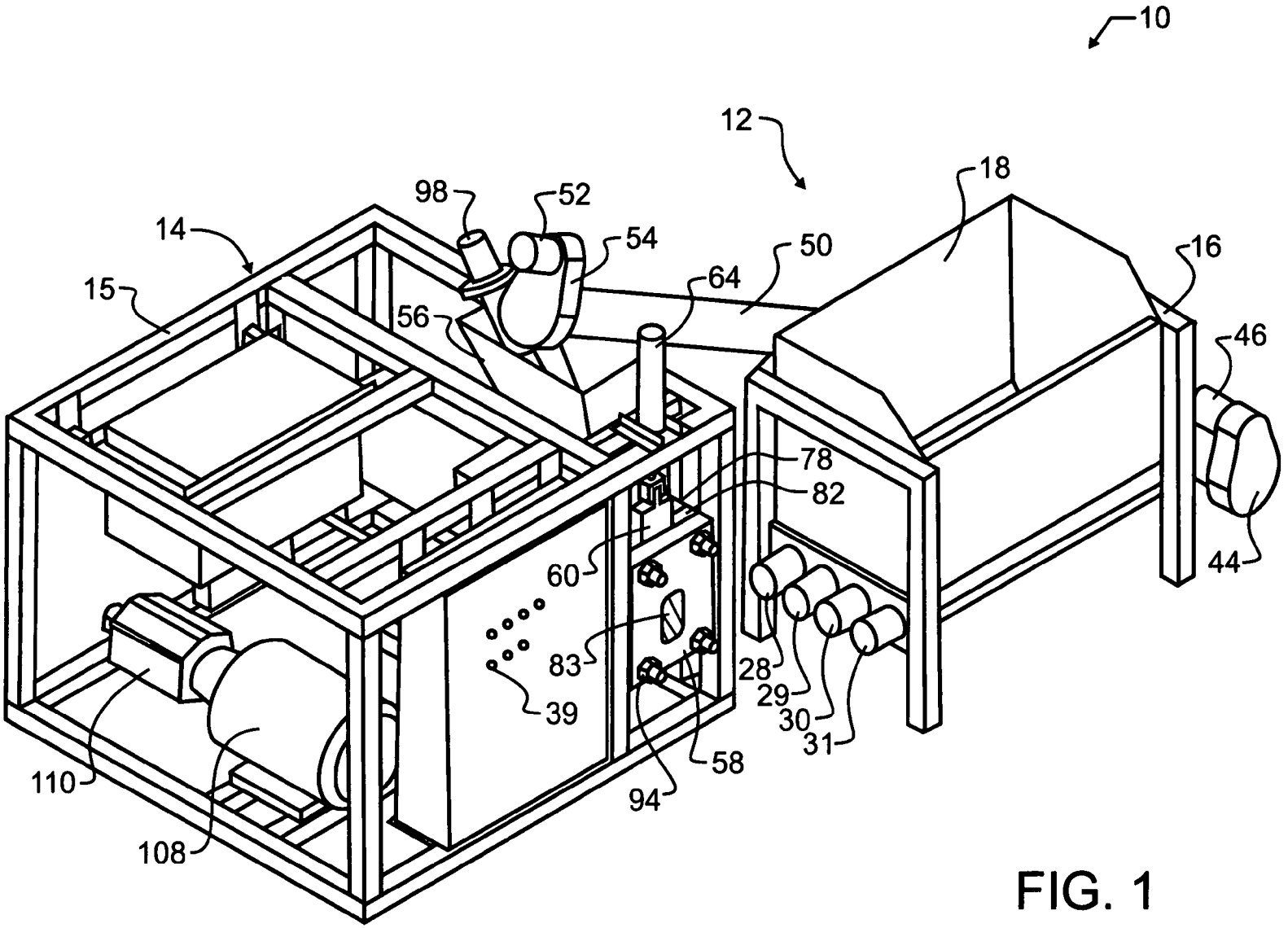
FIG. 1 illustrates a preferred embodiment compacting apparatus designed in accord with the teachings of the present invention from a projected view.

Manifested in the preferred embodiment, the present invention provides a compacting apparatus indicated generally at 10. Compacting apparatus 10 includes a supply hopper unit 12 and a compactor unit 14. The supply hopper unit 12 has a frame 16 that carries a supply bin 18. Supply bin 18 has an open top in order to receive scrap product such as metal shavings entrained with fluids such as cutting fluids. While the preferred embodiment has been optimized for use specifically with metal shavings and similar metal scrap produced during metal machining, those skilled in the art will recognize that the teachings provided herein could be applied to other scrap material as well, provided adequate consideration is given to the characteristics of such other material.

Figure 2:
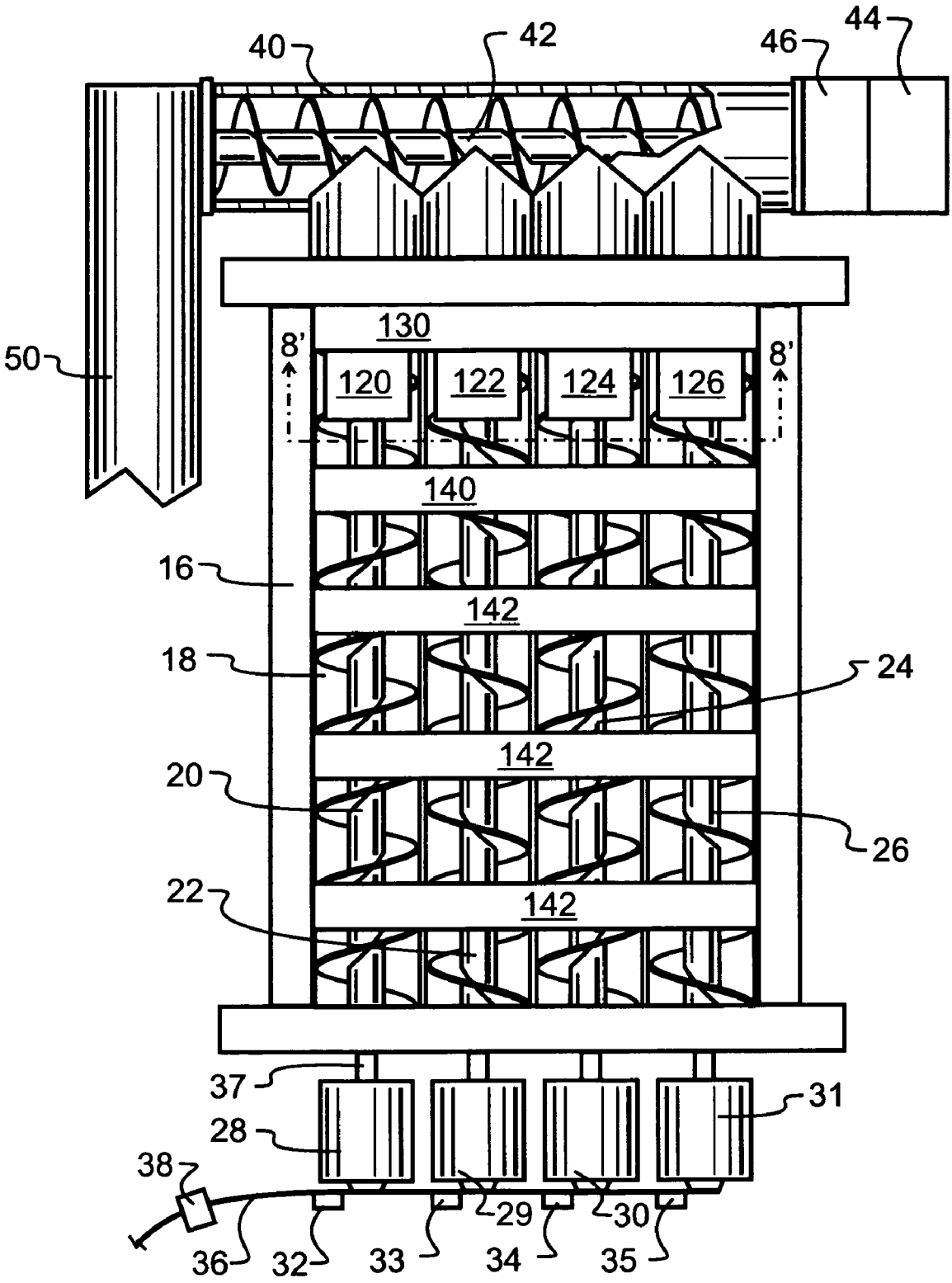
FIG. 2 illustrates a preferred embodiment supply hopper used in the preferred compacting apparatus of FIG. 1 from a top view.

The bottom of the supply bin 18 is comprised of a plurality of spaced apart, parallel grinding augers, as visible in FIG. 2. Augers 20, 22, 24 and 26 are mounted to the frame 16 at the lower end thereof. Each auger is driven by a separate auger motor. Auger motor 28 is mounted outside of frame 18 and is connected by a shaft 37 to the shaft of the first grinding auger 20. Likewise, motors 29, 30, and 31 connect respectively to grinding augers 22, 24 and 26. The motors 28-31 may be hydraulic motors that receive hydraulic fluid from a hydraulic line 36 in order to operate, electric motors that are powered through electrical cable, or may comprise any other suitable motive power source.

Augers 20-26 operate in counter-rotating pairs. Augers 20, 22 rotate toward one another as viewed from above, in clockwise and counterclockwise fashion. Augers 24, 26 also rotate toward one another as viewed from above. Material deposited into bin 18, such as, for exemplary purposes, metal shavings, are ground by the counter-rotating augers and advanced forward in bin 18. Large chunks of metal may be included with fine shavings in many operations, and, where most preferably appropriately designed, augers 20-26 may include additional features that assist in the grinding operation, as known in the auger art, that will reduce the size of such larger pieces of metal material.

Motors 28-31 are most preferably connected to individual load sensors 32-35 and a reversing control 38. Load sensors 32-35 may comprise torque, load, force, pressure, magnetic field or other known sensors which will suitably detect a load indicative of a jam. These load sensors do not have to be individually coupled in one-to-one relationship to each single auger, or be representative of the state of a single auger, but may alternatively be coupled to and sense the operation of an auger pair such as augers 22 and 24. If one of the augers 22-26 jams or becomes blocked due to interference with a piece of material, the individual auger, or, alternatively, the auger pair, or in a further alternative all of the augers, will be momentarily reversed in direction by action of reversing control 38 to dislodge the material. The exact construction of reversing control 38 will depend upon the type of motors selected for motors 28-31, but may, for exemplary purposes be a polarity reversing switch or a hydraulic flow-reversing valve. After a pre-set amount of time, reversing control 38 will once again reset to the original forward setting, causing the jammed auger or auger pair to resume normal rotation in cooperation with its mating auger. Most preferably, if a jam is still detected by the appropriate one of load sensors 32-35, the auger or auger pair will be stopped, and the remaining augers or auger pairs will be operated to empty bin 18. The remaining augers or auger pairs may in fact be accelerated slightly, where desired, to maintain a constant feed volume. When the mode of operation switches to a "jammed and emptying" mode, most preferably a signaling device will indicate the same to users, so that the users know to not add any new material to bin 18. The signaling device may, for exemplary purposes only and not limited thereto, comprise an indicator light and buzzer 39 such as illustrated in FIG. 1, or other suitable audio, visual or other device. In an alternative embodiment, or by the setting of appropriate controls, when a jam is detected the user may also switch to manual mode, to individually control the direction of augers 20-26, and to thereby permit the operator to directly control operation to better break the jam.

Figure 8:
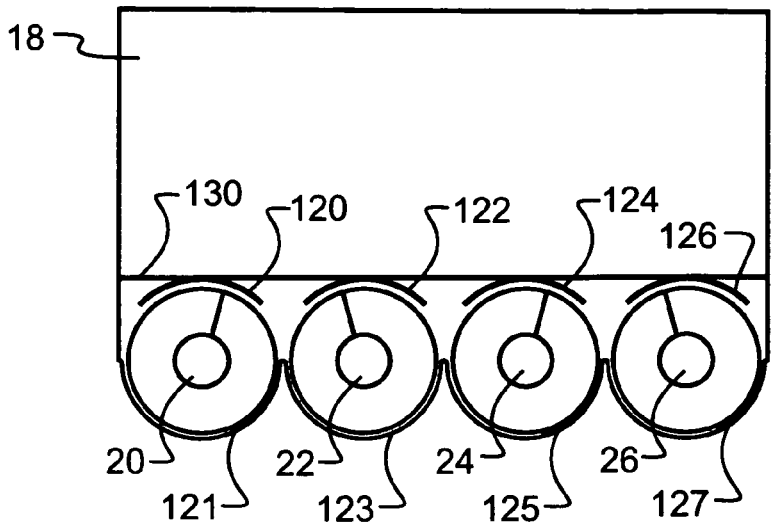
FIG. 8 illustrates a side sectional view of the supply hopper unit taken along line 8' of FIG. 2.

Grinding augers 20-26 move material from bin 18 into a manifold 40 connected at the end of bin 18. As the material moves, there may be a bundling of balls of strings that occurs adjacent the augers. To prevent such formation from interfering with continued proper functioning, one or more shearing bars 140, 142 sever the bundles adjacent the augers as the bundles travel. Once severed, the bundle will gradually be worked back into the augers, and will once again be severed as it passes adjacent shearing bars 140, 142. In addition to shearing bars 140, 142, an additional set of curved arcs 120, 122, 124, 126, which in the preferred embodiment comprise segments of pipes 121, 123, 125 and 127, are provided adjacent to a final shearing bar 130. This combination of pipe segments 120, 122, 124, 126, pipe segments 121, 123, 125 and 127, and final shearing bar 130 serve to break up any clumps of material, that might otherwise create a jam, as the material passes out of bin 18 into manifold 40. A sectional view illustrating this arrangement of pipe segments 120, 122, 124, 126, pipes 121, 123, 125 and 127 and final shearing bar 130 with augers 20-26 and bin 18 is shown in FIG. 8.

A first cutting and conveying auger 42 is located in manifold 40. Conveying auger 42 is operated by a hydraulic motor 44 through a drive and transmission housing 46, and will most preferably pass in front of pipes 121, 123, 125 and 127 sufficiently rapidly with a sufficiently fine screw pitch to cut material entering into manifold 40 from each individual one of these pipes 121, 123, 125 and 127. Cutting and conveying auger 42 connects to and conveys the cut material to a second conveying auger 50. Conveying auger 50 extends from the output of the first conveying auger 40 up to a position poised over the top of a feed hopper 56 located as part of compactor unit 14 and mounted on frame 15 of compactor unit 14. Conveying auger 50 is driven by a motor 52 through a drive housing 54.

Figure 3:
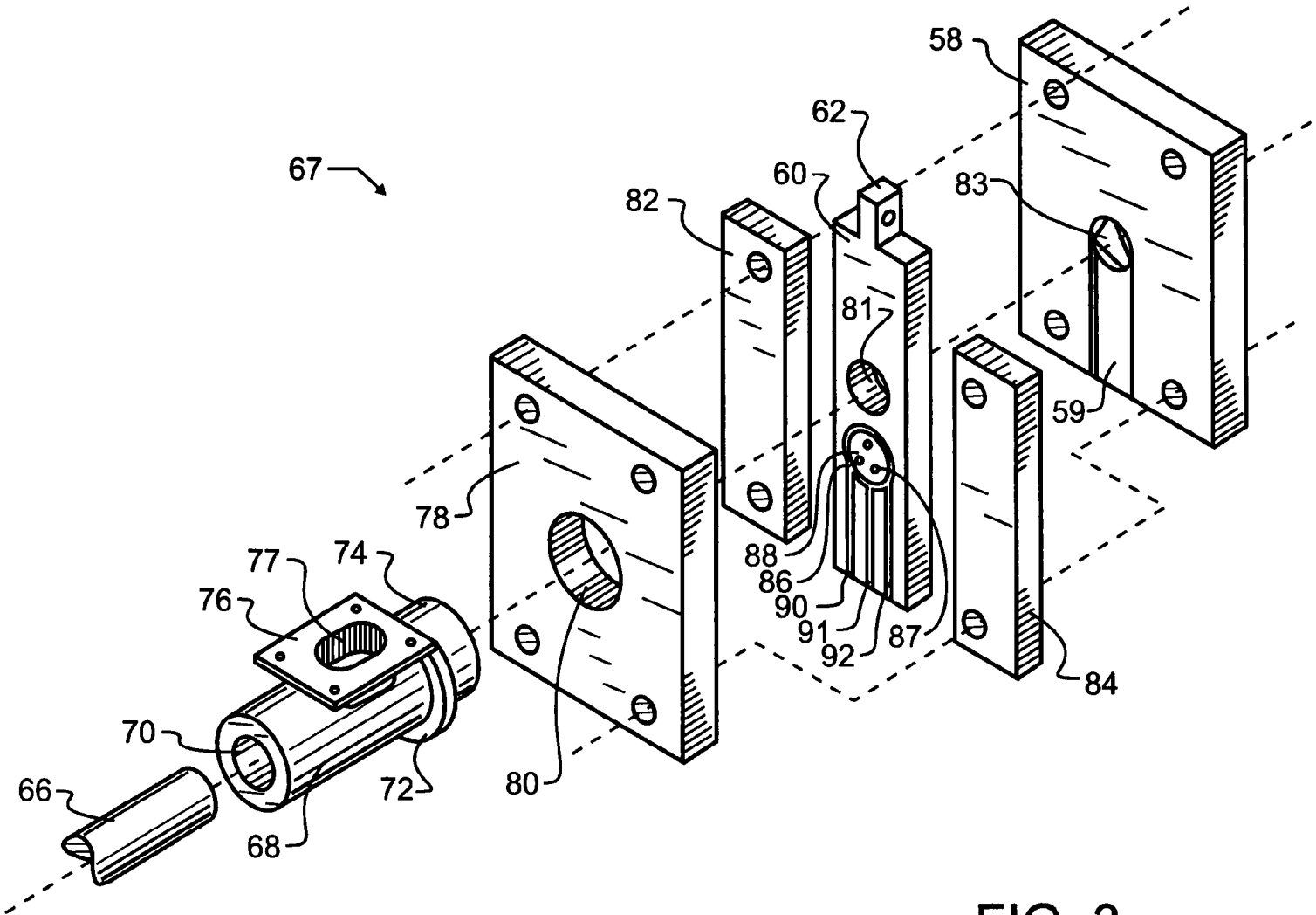
FIG. 3 illustrates a preferred compactor cylinder assembly used in the preferred compacting apparatus of FIG. 1 by exploded view.

A compactor assembly 67, shown by exploded view in FIG. 3, is connected to a frame 15 of compactor unit 14, and is positioned to accept scrap material from feed hopper 56. FIG. 1 shows front plate 58 of compactor assembly 67. A gate 60 is positioned behind the front plate 58 and has an upstanding lug or arm 62. A power cylinder 64, preferably of the hydraulic piston-cylinder variety, is connected to upstanding arm 62 for raising and lowering gate 60 as will be described herein below.

Figure 9:
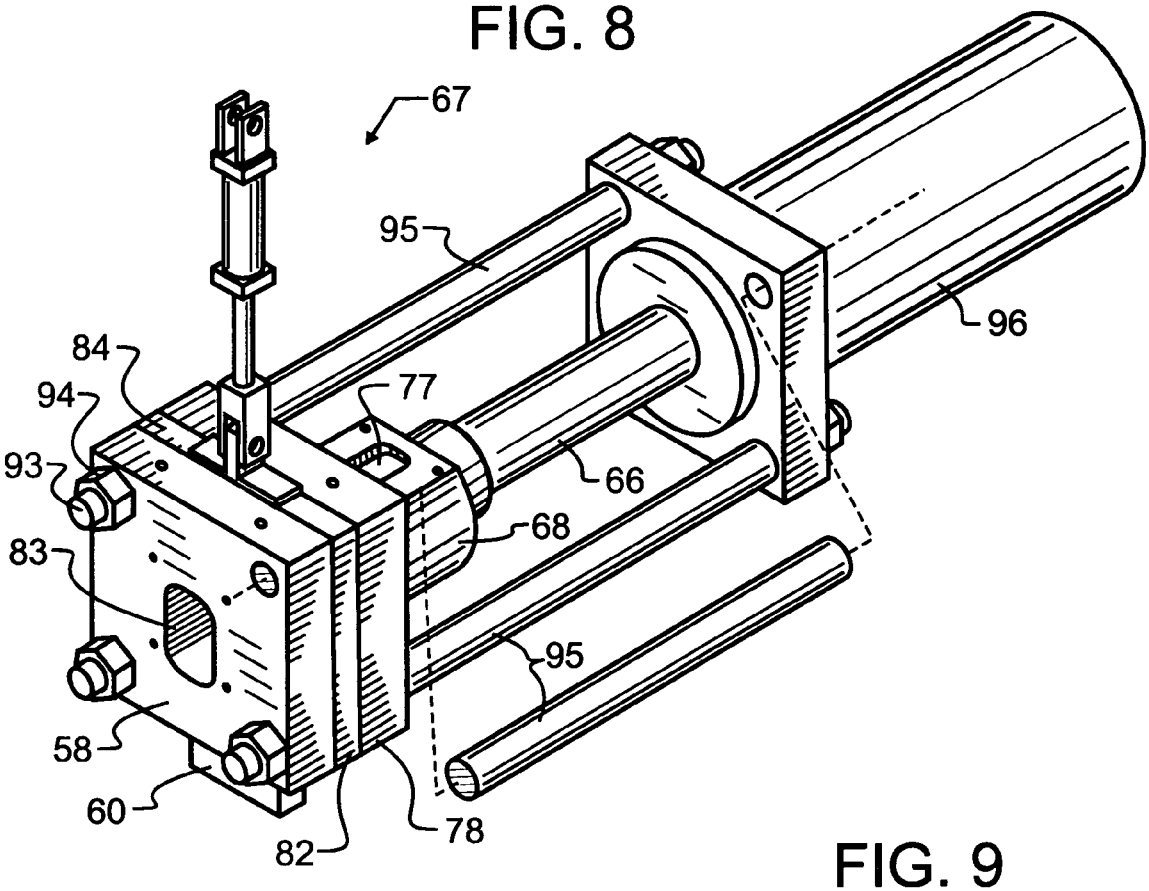
FIG. 9 illustrates the preferred compactor cylinder assembly of FIG. 3, including a slightly modified alternative embodiment cylinder by projected view.

FIG. 3 illustrates by exploded view the preferred compactor assembly 67 in greater detail, while FIG. 9 illustrates compactor assembly 67 in assembled form, with one precision spacer exploded therefrom. As visible therein, compactor assembly 67 includes a piston or plunger 66 and a co-operating cylinder 68. Cylinder 68 has a central chamber or bore 70 formed therein. Plunger 66 is sized to permit reciprocal movement within central bore 70. Cylinder 68 also has an outside shoulder 72 and a front end 74 extending forward of the shoulder 72. A flange 76 connects to a top opening 77, which in turn opens into bore 70. Flange 76 connects to feed hopper 56.

A mounting block 78 has an opening 80 to receive and support front end 74 of cylinder 68. Gate 60 is positioned in facing relationship to mounting block 78. Side rails 82, 84 are positioned on either side of gate 60 to contain upward and downward movement of gate 60. Front plate 58 is situated adjacent to gate 60 and the side rails 82, 84, but on the major surface or side opposite that of mounting block 78.

Gate 60 has drain channels formed therein which facilitate draining of fluids extruded from scrap material being compacted. A circular drain channel 86 surrounds a pressure face 88. Drain channels 90-92 are coupled with and extend downwardly from circular drain channel 86. In the preferred embodiment, drain channels 86 and 90-92 are formed as grooves in the major side surface of gate 60 that faces mounting block 78. Additional drain holes 87 may optionally be provided passing through gate 60 from pressure face 88 to the opposed major surface adjacent front plate 58. In such instance, drain holes 87 will most preferably be conical, to prevent any scrap material which might extrude therein from blocking the hole. Since the hole is conical, and gets larger as the material would extrude through, any such extruded material will tend to be discharged. Fluid passing through drain holes 87 will most preferably be gathered at least in part within drain channel 59 formed in front plate 58. The decision on whether to include drain holes 87 must factor in the desired amount of dwell time and rate of formation of pellets 102, as well as the acceptable amount of machining fluid that may pass out into a pellet collection receptacle. It should be understood that fluid will be pressed through these holes rather forcefully when the holes are open, which may prevent collection of a certain amount of the fluid in the intended fluid collection receptacle and may instead lead to less desirable collection within the pellet receptacle.

Mounting block 78, side rails 82, 84 and front plate 58 all have mounting holes which are in alignment when assembled together, for purposes of securing them with appropriate tie rods 93 and nuts 94 as shown in FIG. 1 and FIG. 9. Most preferably, precision matched-length spacers 94 surround tie rods 93 between mounting block 78 and power cylinder 96 as shown in FIG. 9. Spacers 95 ensure proper alignment of plunger 66, regardless of how evenly each of the nuts 94 are tightened, thereby avoiding potential damage to the machine if the nuts are unevenly tightened.

FIGS. 1 and 9 show side rail 82 disposed behind front plate 58 and in confronting relationship to mounting block 78. Gate 60 is slidably positioned between side rails 82, 84 on the minor side surfaces thereof and between mounting block 78 and front plate 58 on the major front and rear surfaces. Most preferably, at the time of fabrication, gate 60 will be ground with side rails 82, 84 to ensure that each are of exactly the same thickness. Then gate 60 is subsequently ground sufficiently more to ensure adequate clearance to enable the necessary sliding movement.

Figure 4:
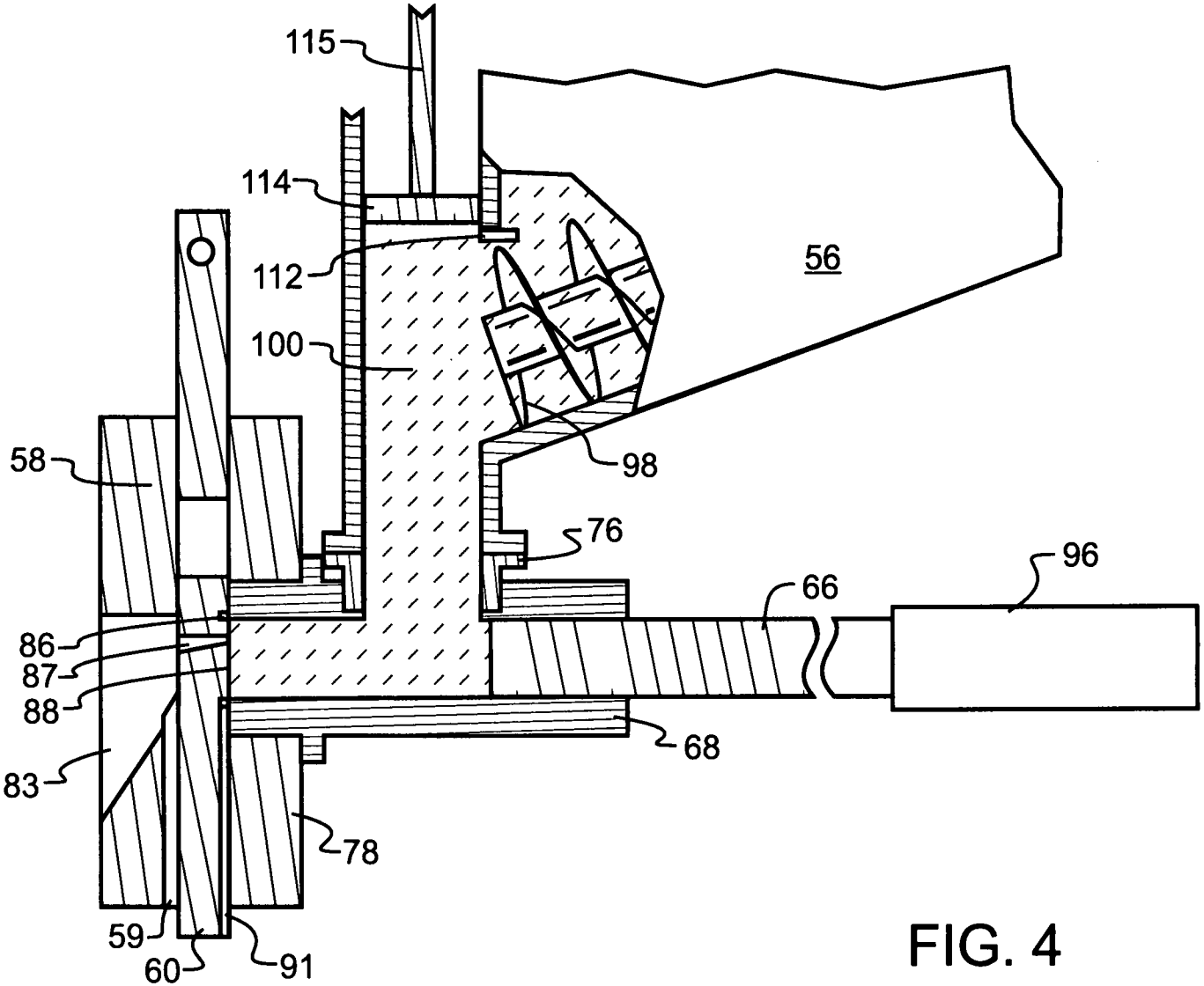
FIG. 4 illustrates a side sectional view of the compactor cylinder assembly in a first stage of the compacting sequence.

Plunger 66 is actuated by a suitable hydraulic cylinder 96, shown in FIGS. 4 and 9. FIG. 4 also illustrates the connection of feed hopper 56 to flange 76. A feed auger assembly 98 is preferably located in feed hopper 56 to move material through top opening 77 of flange 76 and into bore 70 within cylinder 68. The material, such as ground metal waste entrained with machining oil, is indicated at 100 in FIG. 4. It passes from feed hopper 56 into bore 70 of cylinder 68 while plunger 66 is in the retracted position shown in FIG. 4.

In the position illustrated by FIG. 4, gate 60 is at an upward end of travel, and pressure face 88 confronts the end of bore 70 within cylinder 68. Circular drain channel 86 is located along an interior perimeter of the outer diameter of bore 70.

Figure 5:
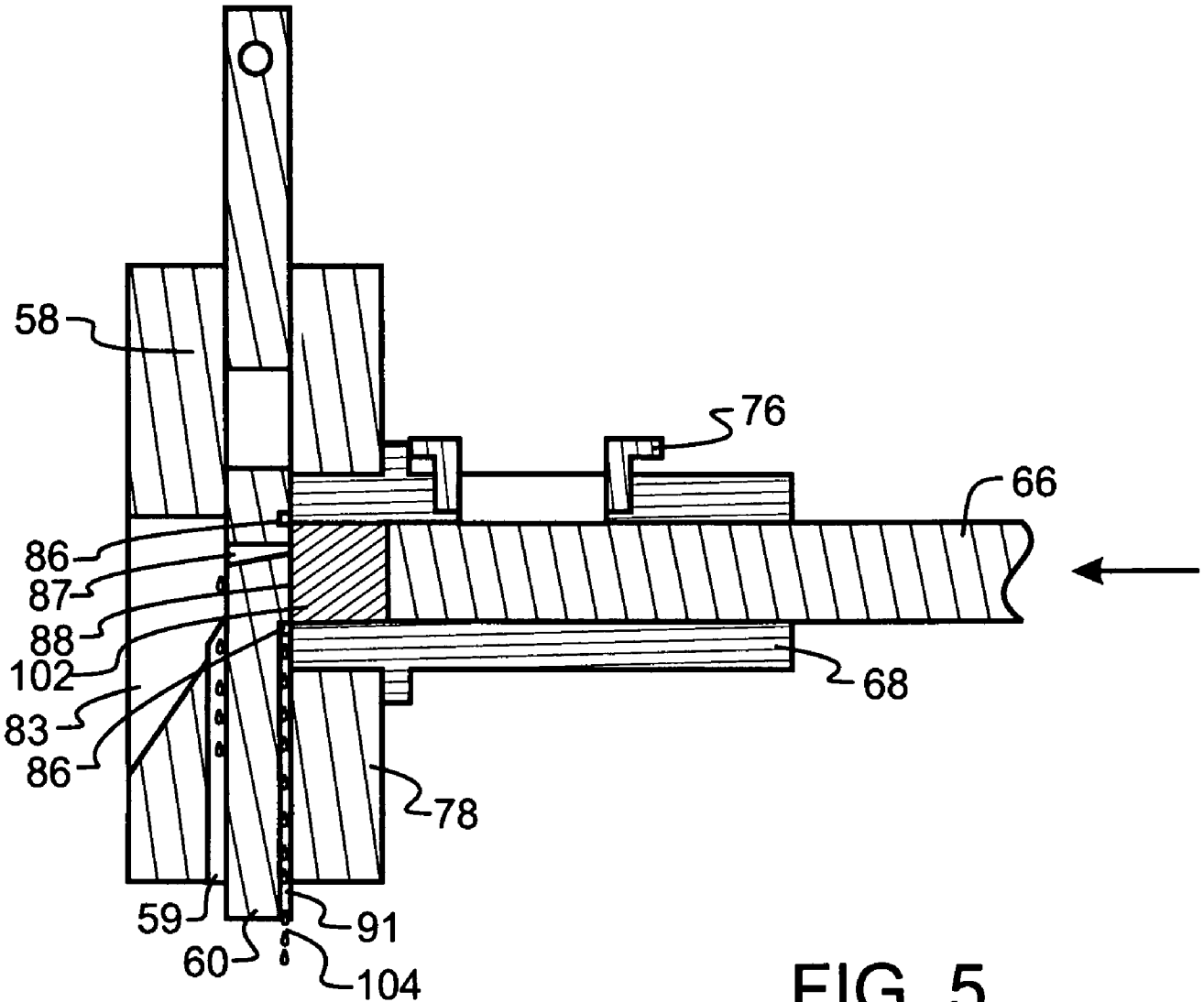
FIG. 5 illustrates a side sectional view of the compactor cylinder assembly in a second stage of the compacting sequence.

In accord with a preferred method of operation, the compacting sequence begins with plunger 66 in the retracted position illustrated in FIG. 4, closing a first end of bore 70. Bore 70 is loaded with scrap material 100 that, in the preferred embodiment comprises loose and ground machining scrap metal entrained with machining fluids. Plunger 66 advances from the position of FIG. 4 to that of FIG. 5. In doing so, it compacts material 100 against pressure face 88 of gate 60, to thereby form a compacted pellet or block 102 of scrap material that is shaped like a puck. At the same time, fluid 104 is compressed out of and exudes from scrap material 100. Fluid 104 enters channel 86 that surrounds pressure face 88 of gate 60. From channel 96, fluid 104 travels down drain channels 90, 91, and 92, being pressurized from the compaction and further influenced by gravity, into a suitable receptacle such as a pan where the fluid can be removed and recycled.

The travel of plunger 66 may be responsive to a pressure sensed on plunger 66, for example, 30,000 psi, or it may be regulated by a proximity switch or other suitable means which will be used to initiate a reverse direction of plunger 66. The particular pressure targeted or selected is dependent upon the composition of scrap material 100, but will most preferably be sufficiently high to for a very solid puck, as free of fluids as possible. This ensures good and efficient handling and use of pellets 102, both previous to the recycler and subsequent thereto.

Figure 6:
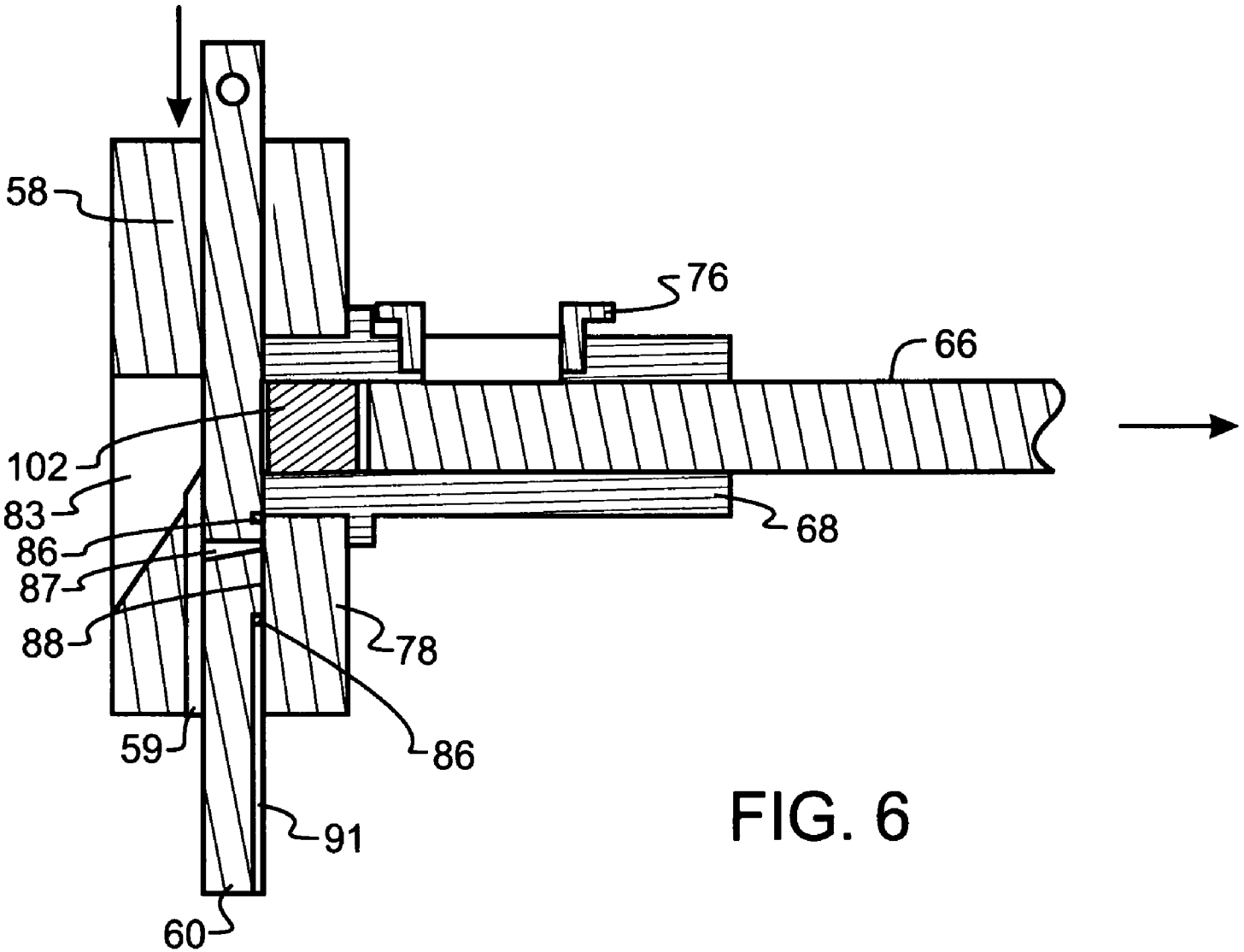
FIG. 6 illustrates a side sectional view of the compactor cylinder assembly in a third stage of the compacting sequence.
Figure 7:
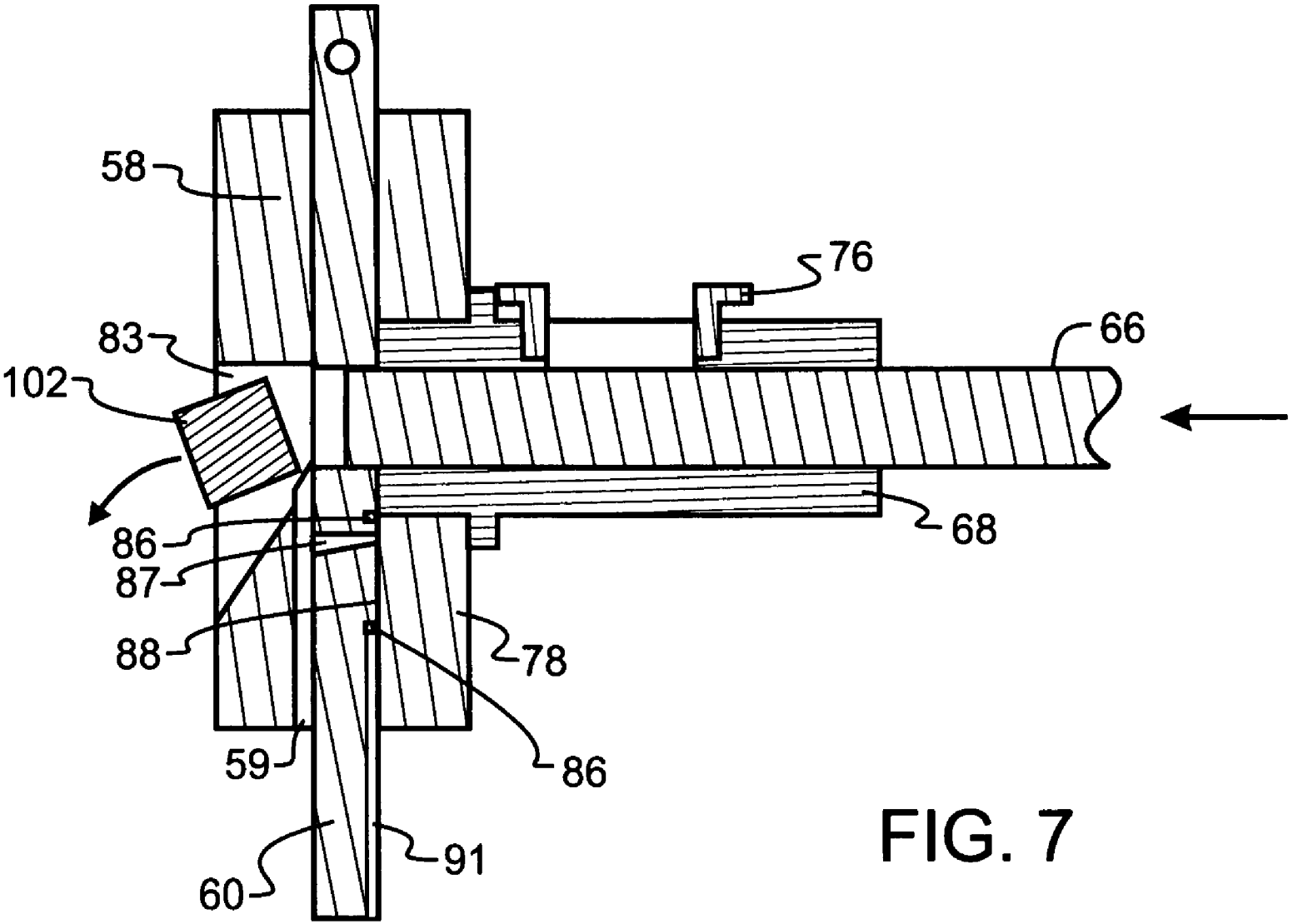
FIG. 7 illustrates a side sectional view of the compactor assembly in a fourth stage of the compacting sequence.

Once pellet 102 has been formed, plunger 66 is retracted a short distance from pellet 102. This is shown in FIG. 6. Backing off of plunger 66 relieves pressure on pellet 102 and gate 60. Next, gate 60 is moved by power cylinder 64 to a position where discharge aperture 81 in gate 60 aligns with bore 70 and pellet 102. This can involve either lowering or raising the gate 60. In the configuration shown in FIGS. 4 through 7, it involves lowering gate 60 through the use of the hydraulic-piston power cylinder 64. This movement is preferred, since any errant fluid 104 is directed downward under the force of gravity towards the outlets of drain channels 90-92, and away from discharge aperture 81. This in turn provides more efficient removal of fluid 104, and reduces the need for subsequent draining or drying of pellet 102.

Once gate 60 is lowered to the position shown in FIG. 6, plunger 66 is again advanced. It advances a distance sufficient to move pellet 102 through discharge aperture 81 of gate 60 and through another discharge opening 83 of the front plate 58. The opening 83, as shown, is outwardly tapered to expedite discharge of pellet 102.

By way of example, in retracting plunger 66 according to FIG. 6, the plunger can retract a distance of one-half inch. It can then be advanced a distance of two inches in order to move pellet 102 out of position and discharge it through front plate 58 to a receptacle.

A suitable programmable logic controller, processor, or other suitable device may control the operation of compactor assembly 67, the various augers, and other operations as desired and suitable for a given design. As shown in FIG. 1, a hydraulic pump 108 is operated by an electric motor 110. This provides hydraulic fluid for the various auger motors and the actuators 64, 92 operating gate 60 and plunger 66, respectively. A proximity switch 112 is located in feed hopper 56, best visible in FIG. 4. Proximity switch 112 is connected through the controller to motors 28-31, operating grinding augers 20-26, and motors 44 and 52 driving conveying augers 42 and 50. When material 100 reaches a preselected level in feed hopper 56 as sensed by proximity sensor 112, the previously mentioned augers are turned off. When the level of material 100 recedes to a predetermined level in feed hopper 56, the augers are again energized.

Plunger 66 advances in cylinder 68 until a predetermined target pressure is reached, for example, 30,000 psi. The plunger stays there for a certain "dwell time", and then backs off. At that point, gate 60 opens to align gate aperture 81 with bore 70. Plunger 66 then advances to knock pellet 102 out of bore 70. Having done that, plunger 66 fully retracts to the position of FIG. 4 preparatory to loading bore 70 again. This can trip a switch that closes gate 60 and starts the cycle over again.

While the foregoing details what is felt to be the preferred embodiment of the invention, no material limitations to the scope of the claimed invention are intended. Further, features and design alternatives that would be obvious to one of ordinary skill in the art are considered to be incorporated herein. As but one example, while four augers are illustrated herein in the preferred embodiment bin 18, it will be recognized that the number of augers will be dependent upon the particular design and features desired by the designer. Furthermore, while only one layer of augers are illustrated, it is further contemplated herein that additional layers of augers may be provided. In one such embodiment, a layer of four augers may be provided parallel to and vertically displaced from augers 20-26 which operate in a direction opposite to augers 20-26. Such a design provides more commination of scrap material, and will help to break up longer strings of material that might be present as a product of screw machine and lathe operations. Consequently, the scope of the invention is set forth and particularly described in the claims herein below.

I claim:

1. A supply hopper suitable for supplying a compacting apparatus with metal scrap material entrained with fluid, comprising:

a bin operative for receiving and supporting said metal scrap material therein;

a plurality of augers within said bin operative to transport diverse sizes of said metal scrap material; and at least one shear bar cooperative with and extending transverse to and substantially across said plurality of augers to shear oversized metal scrap material being transported by said plurality of augers.

2. The supply hopper of claim 1, further comprising:

a means for detecting a jam within individual ones of said plurality of augers; and a means for selectively stopping and selectively reversing said individual ones of said plurality of augers independently of other ones of said plurality of augers responsive to said jam detecting means, whereby a jammed individual auger will be reversed to clear a jam, and, if reversing fails to clear said jam, said other ones of said plurality of augers will continue to operate.

3. The supply hopper of claim 1, wherein said plurality of augers further comprise a plurality of generally parallel augers adjacent a bottom of said bin.

4. The supply hopper of claim 1, wherein said plurality of augers further comprise four parallel augers that operate in counter-rotating pairs.

5. The supply hopper of claim 1, wherein said plurality of augers further comprise a plurality of grinding augers.

6. The supply hopper of claim 1, further comprising a separate drive motor for and coupled with each one of said plurality of augers.

7. The supply hopper of claim 1, wherein said at least one shear bar further comprises a plurality of sequential shear bars.

8. The supply hopper of claim 1, wherein said at least one shear bar extends entirely across said plurality of augers.

9. The supply hopper of claim 1, further comprising:

a manifold coupled to said plurality of augers and receiving said material from said bin; and a cutting and conveying auger within said manifold.

* * * * *